US007107874B1

(12) United States Patent
Chen

(10) Patent No.: US 7,107,874 B1
(45) Date of Patent: Sep. 19, 2006

(54) HAMMER HAVING A DETACHABLE BELL

(76) Inventor: Yung-Shou Chen, 2F-1, No. 51, Sec. 3, Chung Yang Rd., Chung Ho Tsuen, Long-Ching Town, Taichung Hsien (TW)

( * ) Notice: Subject to any disclaimer, the term of this patent is extended or adjusted under 35 U.S.C. 154(b) by 0 days.

(21) Appl. No.: 11/160,852

(22) Filed: Jul. 12, 2005

(51) Int. Cl.
*B25D 1/02* (2006.01)

(52) U.S. Cl. ..... 81/25; 30/308.3

(58) Field of Classification Search ..... 81/20–22, 81/25–27; 30/308.3
See application file for complete search history.

(56) References Cited

U.S. PATENT DOCUMENTS 1,045,145 A * 11/1912 Hubbard ..... 81/22
1,054,929 A * 3/1913 Melluish et al. ..... 30/308.3
1,296,401 A * 3/1919 Jones et al. ..... 30/308.3
1,737,497 A * 11/1929 Gibbs ..... 81/19
1,781,344 A * 11/1930 Salazar ..... 81/22
2,501,757 A * 3/1950 Cagle ..... 7/145
3,148,716 A * 9/1964 Vaughan, Jr. ..... 81/22
4,753,137 A * 6/1988 Kennedy ..... 81/22
5,012,702 A * 5/1991 Taylor ..... 81/25
6,457,384 B1 * 10/2002 Cox et al. ..... 81/22
6,463,832 B1 * 10/2002 Cox ..... 81/22

* cited by examiner

*Primary Examiner*—Debra S Meislin
(74) *Attorney, Agent, or Firm*—Pai Patent & Trademark Law Firm; Chao-Chang David Pai

(57) ABSTRACT

A hammer having a coupling rod extended from a neck at one end of the hammer body of the hammer, a bell detachably attached to the coupling rod, a rubber socket mounted in a transverse through hole of the bell and a transverse through hole of the coupling rod to accommodate a stud nut, and a screw threaded into the stud nut to affix the socket and the bell to the coupling rod of the hammer body.

12 Claims, 3 Drawing Sheets

HAMMER HAVING A DETACHABLE BELL

BACKGROUND OF THE INVENTION (a) Field of the Invention

The present invention relates to a hammer and, more particularly, to a hammer having a detachable bell.

(b) Description of the Prior Art

A hammer is a tool with a head and a handle, used for driving in nails, etc. Different sizes of hammers of different materials are commercially available for different purposes. After a long use, the head (bell) of the hammer may start to wear. If the face of the head (bell) is damaged, the hammer may be unable to function well. Therefore, hammers with a capped head or attached working surface are developed. These hammers allow the user to replace the cap or working surface of the head thereof when damaged. Exemplars of these designs are seen in U.S. Pat. No. 6,457,384B1, entitled "Capped head hammer", U.S. Pat. No. 6,463,832B1, entitled "Capped head hammer", and U.S. Pat. No. 6,536,308B1, entitled "Tool having an attached working surface". However, these conventional designs are not easy to detach and replace.

SUMMARY OF THE INVENTION

The present invention has been accomplished under the circumstances in view. It is one object of the present invention to provide a hammer which has a detachable bell that is easily replaceable when damaged. It is another object of the present invention to provide a hammer having a detachable bell, which uses rubber packing elements to buffer shocks during operation of the hammer, preventing injury to the user's hand. It is still another object of the present invention to provide a hammer which allows the user to selectively and conveniently attach the hammer with one of a set of bells of different materials (such as rubber bell, stainless steel bell, etc.).

To achieve these and other objects of the present invention, the hammer comprises a hammer body, the hammer body comprising a coupling rod extended from a neck at one end thereof and a through hole transversely extended through the coupling rod; a bell detachably attached to the coupling rod of the hammer body, the bell comprising a coupling hole, which receives the coupling rod of the hammer body, a face for driving or beating things, a first through hole disposed in communication with the coupling hole at one side beyond the face, and a second through hole disposed in communication with the coupling hole at an opposing side beyond the face and in axial alignment with the first through hole; a socket, the socket comprising a head positioned in the first through hole of the bell, a socket body extending from the head and positioned in the through hole of the coupling rod of the hammer body and the second through hole of the bell, and a stepped through hole axially extending through the head and the socket body; a nut positioned in the stepped through hole of the socket; and a headed screw mounted in the second through hole of the bell and fastened up with the nut in the socket.

DETAILED DESCRIPTION OF THE PREFERRED EMBODIMENTS

Figure 1:
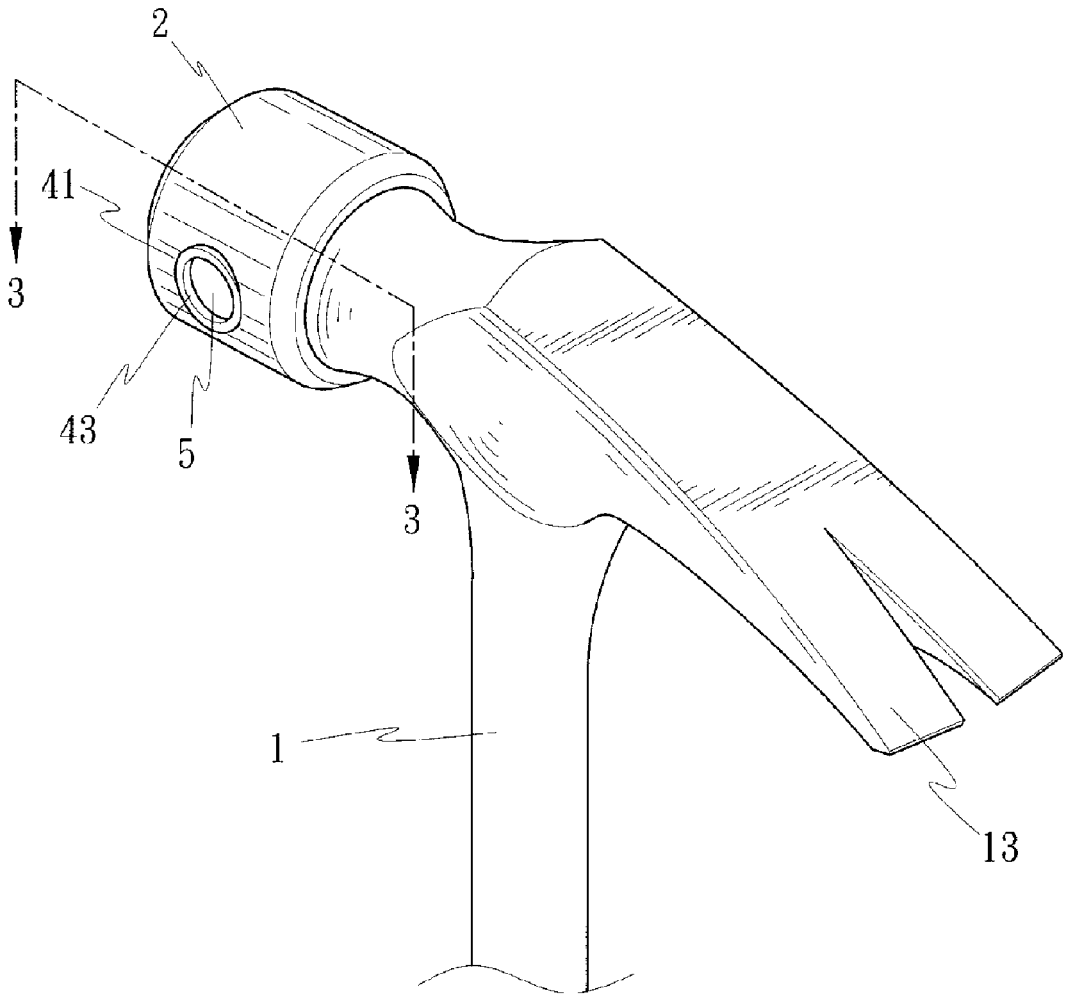
FIG. 1 is a perspective view of a hammer according to the present invention.
Figure 2:
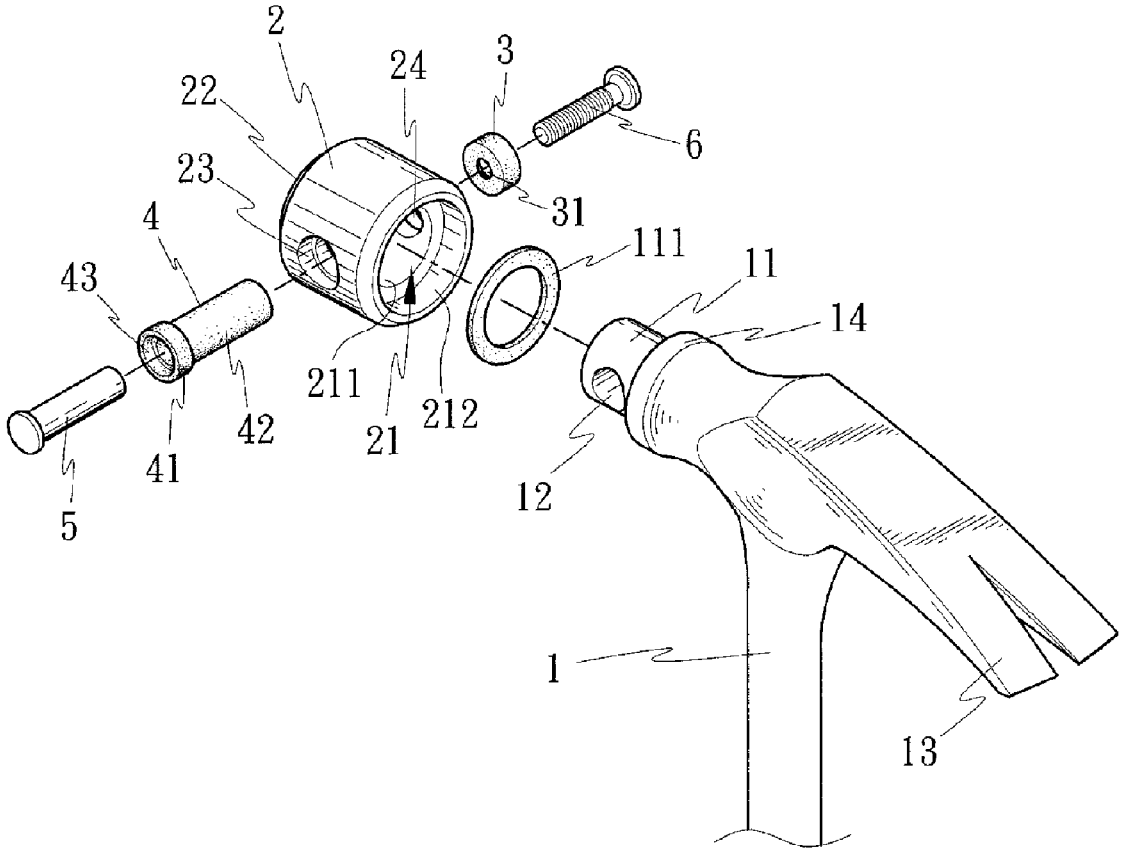
FIG. 2 is an exploded view of the hammer according to the present invention.
Figure 3:
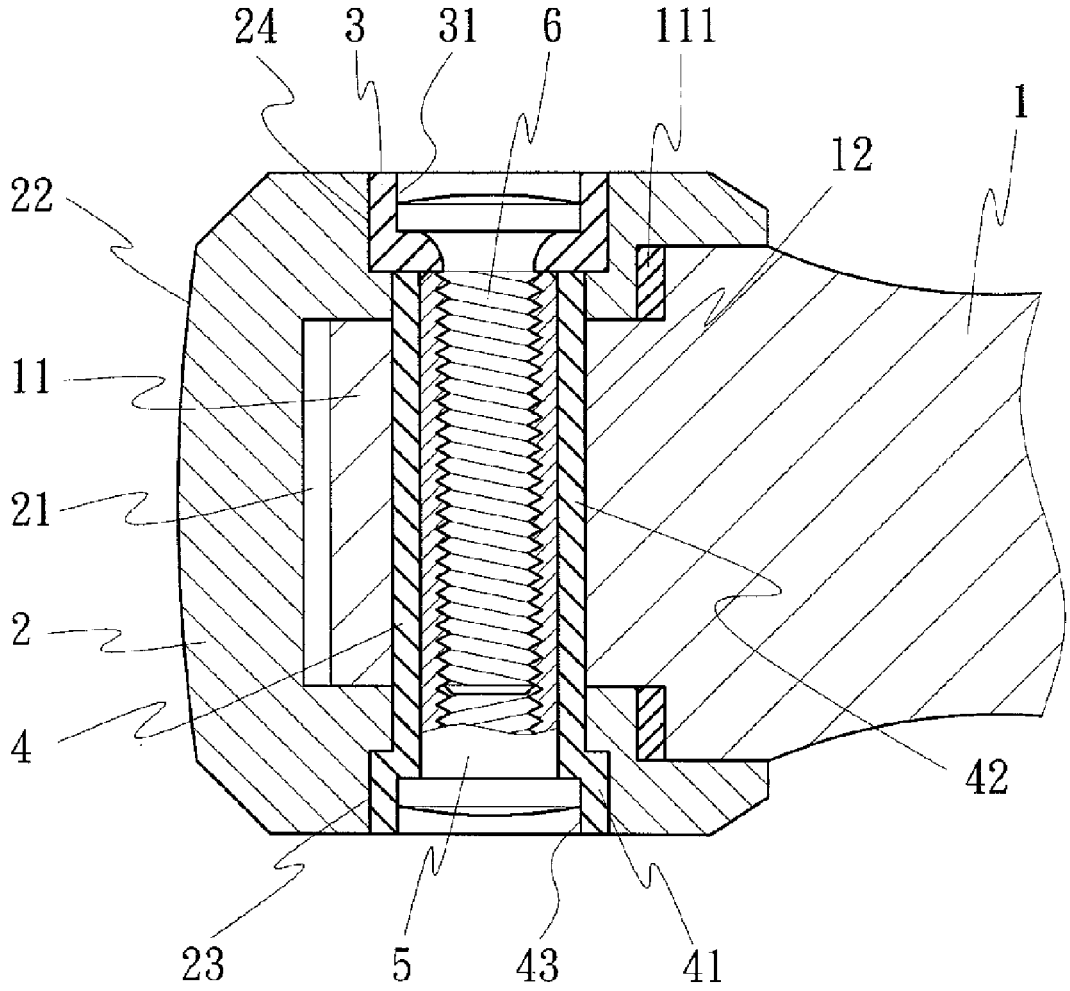
FIG. 3 is a sectional view in an enlarged scale of a part of the hammer taken along line 3—3 of FIG. 1.

Referring to FIGS. 1~3, a hammer in accordance with the present invention is shown comprising a hammer body 1 and a bell 2.

The hammer body 1 comprises a neck 14 extended from one end thereof at right angle, and a cylindrical coupling rod 11 axially forwardly extending from the neck 14. The bell 2 comprises a stepped coupling hole 21, which has a small diameter portion 211 at an inner side and a big diameter portion 212 at an outer side. The neck 14 is inserted into the stepped coupling hole 21 of the bell 2, keeping the cylindrical coupling rod 11 engaged in the small diameter portion 211 and the front part of the neck 14 engaged in the big diameter portion 212. Further, a flexible washer, for example, a rubber washer 1111 is mounted on the cylindrical coupling rod 111 and stopped by the neck 14 against the step between the small diameter portion 211 and big diameter portion 212 of the stepped coupling hole 21 in the bell 2. The bell 2 has a face 22 perpendicular to the extending direction of the cylindrical coupling rod 11, and two stepped through holes, namely, the first stepped through hole 23 and the second stepped through hole 24 disposed in communication with and aligned at two sides of the small diameter portion 211 of the stepped coupling hole 21. The cylindrical coupling rod 111 has a transverse through hole 12 corresponding to the stepped through holes 23 and 24. Further, the body 1 has a claw 13 extended from one end thereof in a direction opposite to the neck 14.

A detachable fastening structure is provided and mounted in the stepped through holes 23 and 24 of the bell 2 and the transverse through hole 12 of the cylindrical coupling rod 111 to affix the bell 2 to the neck 14 of the hammer body 1. This detachable fastening structure comprises a packing 3, a socket 4, a stud nut 5, and a headed screw 6. The packing 3 and the socket 4 are made of flexible material, for example, rubber. The socket 4 has a tubular socket body 42 inserted through the first stepped through hole 23 and the transverse through hole 12 of the cylindrical coupling rod 111 and the small diameter portion of the second stepped through hole 24, a head 41 connected to one end of the tubular socket body 42 and fitted into the outer big diameter portion of the first stepped through hole 23, and a stepped through hole 43 axially formed in the head 41 and the tubular socket body 42. The stud nut 5 is fitted into the stepped through hole 43 of the socket 4. The packing 3 is mounted in the outer diameter portion of the second stepped through hole 24 of the bell 2, having a stepped through hole 31 axially extending at the center. The headed screw 6 is inserted through the stepped through hole 31 of the packing 3 and threaded into the stud nut 5 to secure the socket 4, the stud nut 5, the bell 2 and the cylindrical coupling rod 11 together, keeping the head of the headed screw 6 rested in the big diameter portion of the stepped through hole 31 of the packing 3.

The aforesaid packing 3 may be eliminated without affecting the functioning of the detachable fastening structure. After connection of the bell 2 to the body 1, the socket 4 and the stud nut 5 are inserted into the bell 2 in proper order, and then the packing 3 is mounted in the bell 2, and then the headed screw 6 is inserted through the packing 3 and fastened up with the stud nut 5 to affix the bell 2 to the hammer body 1. When the headed screw 6 is loosened from the stud nut 5, the parts of the detachable fastening structure can be removed from the bell 2, and the bell 2 can be disconnected from the neck 14 of the hammer body 1 for a replacement.

As indicated above, the invention uses a screw and a nut to detachably lock the bell to the neck of the hammer body. When the bell is damaged or another type of bell is to be used with the hammer body, the bell can easily be detached from the neck of the hammer body for a replacement.

A prototype of hammer has been constructed with the features of the annexed drawings of FIGS. 1~3. The hammer functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A hammer comprising:

a hammer body, said hammer body comprising a coupling rod extended from a neck at one end thereof and a through hole transversely extending through said coupling rod;

a bell detachably attached to said coupling rod of said hammer body, said bell comprising a coupling hole, which receives said coupling rod of said hammer body, a face for driving or beating things, a first through hole disposed in communication with said coupling hole at one side beyond said face, and a second through hole disposed in communication with said coupling hole at an opposing side beyond said face and in axial alignment with said first through hole;

a socket, said socket comprising a head positioned in said first through hole of said bell, a socket body extending from said head and positioned in the through hole of said coupling rod of said hammer body and said second through hole of said bell, and a stepped through hole axially extending through said head and said socket body;

a nut positioned in the stepped through hole of said socket; and a headed screw mounted in said second through hole of said bell and fastened up with said nut in said socket.

2. The hammer as claimed in claim 1, wherein the face of said bell is disposed perpendicular to the extending direction of said coupling rod of said hammer body.

3. The hammer as claimed in claim 1, wherein said coupling rod of said hammer body has a cylindrical shape.

4. The hammer as claimed in claim 1, further comprising a washer mounted on said coupling rod of said hammer body.

5. The hammer as claimed in claim 4, wherein said washer is a rubber washer.

6. The hammer as claimed in claim 1, wherein said coupling hole of said bell is a stepped hole.

7. The hammer as claimed in claim 1, wherein said socket is a rubber socket.

8. The hammer as claimed in claim 1, wherein said nut is a stud nut.

9. The hammer as claimed in claim 1, further comprising a packing mounted on said headed screw and positioned in said second through hole of said bell.

10. The hammer as claimed in claim 9, wherein said packing is a rubber packing.

11. The hammer as claimed in claim 1, wherein said first through hole is a stepped through hole.

12. The hammer as claimed in claim 1, wherein said second through hole is a stepped through hole.

* * * * *